US011739392B2

(12) United States Patent
Kimata et al.

(10) Patent No.: US 11,739,392 B2
(45) Date of Patent: Aug. 29, 2023

(54) HIGH-STRENGTH STEEL SHEET AND METHOD FOR MANUFACTURING THE SAME

(71) Applicant: JFE STEEL CORPORATION, Tokyo (JP)

(72) Inventors: Yusuke Kimata, Tokyo (JP); Yoshihiko Ono, Tokyo (JP); Kenji Kawamura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 646 days.

(21) Appl. No.: 16/076,374

(22) PCT Filed: Feb. 7, 2017

(86) PCT No.: PCT/JP2017/004310
§ 371 (c)(1),
(2) Date: Aug. 8, 2018

(87) PCT Pub. No.: WO2017/138503
PCT Pub. Date: Aug. 17, 2017

(65) Prior Publication Data

US 2019/0040482 A1 Feb. 7, 2019

(30) Foreign Application Priority Data

Feb. 10, 2016 (JP) ..... 2016-023453
Dec. 5, 2016 (JP) ..... 2016-235854

(51) Int. Cl.
*C21D 8/02* (2006.01)
*C21D 9/46* (2006.01)
(Continued)

(52) U.S. Cl.
CPC ..... *C21D 8/0247* (2013.01); *C21D 6/002* (2013.01); *C21D 6/005* (2013.01); *C21D 8/0205* (2013.01);
(Continued)

(58) Field of Classification Search
CPC ..... C21D 9/46; C21D 1/18; C21D 8/0226; C21D 8/0247; C21D 2211/001;
(Continued)

(56) References Cited

U.S. PATENT DOCUMENTS

2006/0137769 A1* 6/2006 Yuse ..... C22C 38/04 420/103
2011/0162762 A1* 7/2011 Matsuda ..... C21D 9/48 148/333
(Continued)

FOREIGN PATENT DOCUMENTS

CN 102747272 B * 8/2014
CN 104508163 A 4/2015
(Continued)

OTHER PUBLICATIONS

Machine Translation of CN-102747272-B (Year: 2014).*
(Continued)

*Primary Examiner* — Kevin E Yoon
*Assistant Examiner* — Ryan L Heckman
(74) *Attorney, Agent, or Firm* — Oliff PLC

(57) ABSTRACT

A high-strength steel sheet having a tensile strength TS of 1320 MPa or more and excellent workability. The high-strength steel sheet has a chemical composition containing, by mass %, C: 0.20% or more and 0.40% or less, Si: 0.5% or more and 2.5% or less, Mn: more than 2.4% and 5.0% or less, P: 0.1% or less, S: 0.01% or less, Al: 0.01% or more and 0.5% or less, N: 0.010% or less, and Fe and inevitable impurities. A microstructure of the steel sheet includes, in
(Continued)

(A)UPPER BAINITE (B) LOWER BAINITE terms of area fraction with respect to the whole steel sheet microstructure, lower bainite in an amount of 40% or more and less than 85%, martensite including tempered martensite in an amount of 5% or more and less than 40%, retained austenite in an amount of 10% or more and 30% or less, and polygonal ferrite in an amount of 10% or less (including 0%).

12 Claims, 1 Drawing Sheet

(51) Int. Cl.

| | |
|---|---|
| ***C22C 38/06*** | (2006.01) |
| ***C22C 38/16*** | (2006.01) |
| ***C22C 38/00*** | (2006.01) |
| ***C22C 38/02*** | (2006.01) |
| ***C22C 38/04*** | (2006.01) |
| ***C21D 6/00*** | (2006.01) |
| ***C22C 38/12*** | (2006.01) |
| ***C22C 38/14*** | (2006.01) |

(52) U.S. Cl.
CPC ..... *C21D 8/0226* (2013.01); *C21D 8/0236* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C21D 2211/001* (2013.01); *C21D 2211/002* (2013.01); *C21D 2211/005* (2013.01); *C21D 2211/008* (2013.01)

(58) Field of Classification Search
CPC . C21D 2211/008; B32B 15/013; C22C 38/02; C22C 38/06; C22C 38/38; C22C 38/58; C23C 2/02; C23C 2/40
See application file for complete search history.

(56) References Cited

U.S. PATENT DOCUMENTS

| | | | | |
|---|---|---|---|---|
| 2013/0087253 | A1 | 4/2013 | Matsuda et al. | |
| 2015/0101712 | A1* | 4/2015 | Futamura ..... | C22C 38/002 148/518 |

FOREIGN PATENT DOCUMENTS

| | | | | |
|---|---|---|---|---|
| EP | 2327810 | A1 | | 6/2011 |
| EP | 2 546 375 | A1 | | 1/2013 |
| EP | 2546382 | A1 | | 1/2013 |
| EP | 2881481 | A1 | | 6/2015 |
| EP | 3009527 | A1 | | 4/2016 |
| EP | 3 050 988 | A1 | | 8/2016 |
| EP | 3101147 | A1 | | 12/2016 |
| EP | 3128023 | A1 | | 2/2017 |
| JP | H04-235253 | A | | 8/1992 |
| JP | 11-256273 | A | | 9/1999 |
| JP | 2004-76114 | A | | 3/2004 |
| JP | 2009173959 | A | * | 8/2009 |
| JP | 2013-72101 | A | | 4/2013 |
| JP | 2015-151576 | A | | 8/2015 |
| JP | 2015-224359 | A | | 12/2015 |
| KR | 10-2011-0042369 | A | | 4/2011 |
| KR | 10-2012-0113806 | A | | 10/2012 |
| KR | 20160012205 | A | | 2/2016 |
| WO | 2011/111330 | A1 | | 9/2011 |
| WO | 2015/046339 | A1 | | 4/2015 |
| WO | 2015/115059 | A1 | | 8/2015 |
| WO | 2015/151427 | A1 | | 10/2018 |

OTHER PUBLICATIONS

Machine translation of JP-2009173959-A (Year: 2009).*
Oct. 10, 2018 Search Report issued in European Patent Application No. 17750226.7.
May 16, 2 017 International Search Report issued in International Patent Application No. PCT/JP2017/004310.
Aug. 28, 2019 Office Action issued in Korean Patent Application No. 10-2018-7022339.
Sep. 29, 2019 Office Action issued in Chinese Patent Application No. 201780011000.3.
Mar. 23, 2020 Notice of Allowance issued in Korean Patent Application No. 10-2018-7022339.

* cited by examiner

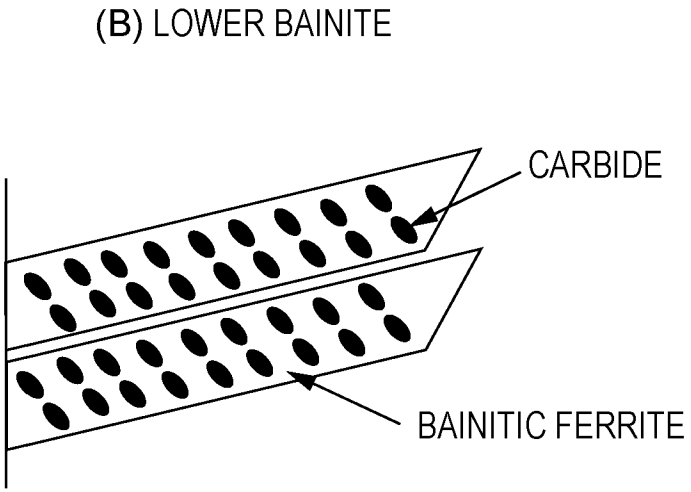
(B) LOWER BAINITE
CARBIDE
BAINITIC FERRITE
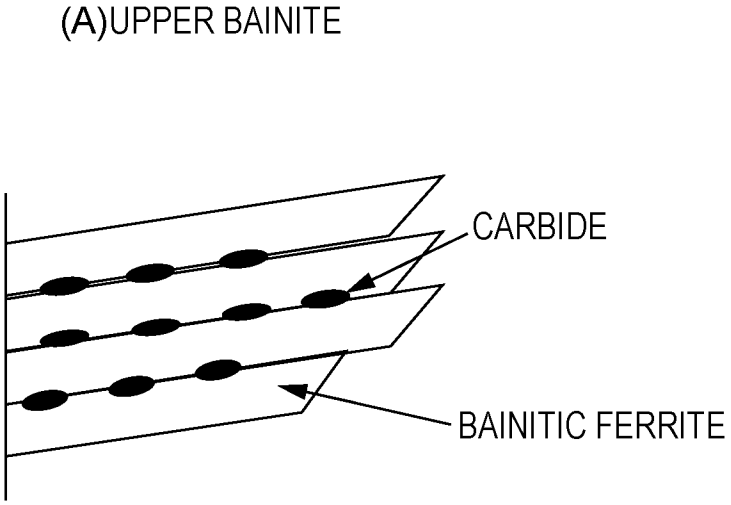
(A)UPPER BAINITE
CARBIDE
BAINITIC FERRITE

HIGH-STRENGTH STEEL SHEET AND METHOD FOR MANUFACTURING THE SAME

TECHNICAL FIELD

The present disclosure relates to a high-strength steel sheet excellent in terms of workability which is optimum for manufacturing automotive outer panels, structural skeleton members, and other kinds of machine structural parts and to a method for manufacturing the high-strength steel sheet.

BACKGROUND ART

Nowadays, an improvement in automobile fuel efficiency is an important issue to be solved from the viewpoint of global environment conservation. Accordingly, there is an active trend toward reducing the weight of an automobile body by reducing the thickness of automobile parts as a result of increasing the strength of a material for the automobile body.

Generally, it is necessary to increase the proportion of hard phases such as martensite and bainite phases to the whole microstructure of a steel sheet in order to increase the strength of the steel sheet. However, since there is a decrease in workability in the case where the strength of a steel sheet is increased by increasing the proportion of hard phases, there is a demand for developing a steel sheet having both high strength and excellent workability. To date, various multi-phase steel sheets such as a DP steel sheet, which has a dual phase consisting of ferrite and martensite, and a TRIP steel sheet, which utilizes the transformation-induced plasticity of retained austenite, have been developed.

In the case where the proportion of hard phases is increased in a multi-phase steel sheet, the workability of the steel sheet strongly depends on the workability of the hard phases. This is because, while the workability of a steel sheet depends mainly on the deformability of polygonal ferrite in the case where the proportion of hard phases is small so that the proportion of soft polygonal ferrite is large, which results in satisfactory workability such as ductility being achieved even if the workability of the hard phases is unsatisfactory, the workability of a steel sheet depends directly on the deformability of hard phases instead of the deformability of polygonal ferrite in the case where the proportion of the hard phases is large.

Therefore, in the case of a cold-rolled steel sheet, the workability of martensite has been improved by controlling the amount of polygonal ferrite formed in an annealing process and a subsequent cooling process, by performing water quenching on the cooled steel sheet in order to form martensite, by reheating the quenched steel sheet, and by holding the heated steel sheet at a high temperature in order to temper martensite so that carbides are formed in martensite, which is a hard phase. However, in the case of continuous annealing water quenching equipment, with which water quenching is performed, since the temperature after quenching is naturally nearly equal to the water temperature, almost all untransformed austenite is transformed into martensite, which makes it difficult to utilize low-temperature-transformation phases such as retained austenite and so forth. Therefore, an improvement in the workability of hard phases is limited to that caused by the effect of tempering martensite, which results in a limited improvement in the workability of a steel sheet.

To date, multi-phase steel sheets containing retained austenite have been disclosed. For example, Patent Literature 1 discloses a high tensile strength steel sheet excellent in terms of bending workability and impact resistance which is manufactured by controlling the contents of predetermined constituent alloy elements and by forming a steel sheet microstructure including fine and homogeneous bainite having retained austenite therein. In addition, for example, Patent Literature 2 discloses a multi-phase steel sheet excellent in terms of bake hardenability which is manufactured by controlling the contents of predetermined constituent alloy elements, by forming a steel sheet microstructure including bainite having retained austenite therein and/or ferrite, and by controlling the amount of retained austenite in bainite. Moreover, for example, Patent Literature 3 discloses a multi-phase steel sheet excellent in terms of impact resistance which is manufactured by controlling the contents of predetermined constituent alloy elements, by forming a steel sheet microstructure including bainite having retained austenite therein in an amount of 90% or more in terms of area fraction, by controlling the amount of retained austenite in bainite to be 1% or more and 15% or less, and by controlling the hardness (HV) of bainite.

CITATION LIST

Patent Literature

PTL 1: Japanese Unexamined Patent Application Publication No. 4-235253

PTL 2: Japanese Unexamined Patent Application Publication No. 2004-76114

PTL 3: Japanese Unexamined Patent Application Publication No. 11-256273

SUMMARY

Technical Problem

However, in the case of the chemical composition according to Patent Literature 1, although satisfactory bendability is achieved, since it is difficult to stably form a sufficient amount of retained austenite, which realizes the TRIP effect in a high-strain range when strain is applied to a steel sheet, there is a problem of a deterioration in bulging formability due to low ductility before plastic instability occurs. In addition, in the case of the steel sheet according to Patent Literature 2, although certain bake hardenability is achieved, since a microstructure including mainly bainite and/or ferrite with the amount of martensite being controlled to be as small as possible is formed, there is a problem not only in that it is difficult to achieve a tensile strength (TS) of more than 1180 MPa, but also in that it is difficult to achieve satisfactory workability when strength is increased. Moreover, in the case of the steel sheet according to Patent Literature 3, since an improvement in impact resistance is primarily intended, and since a microstructure includes mainly bainite having a hardness HV of 250 or less as a main phase, specifically, in an amount of more than 90%, there is a problem in that it is very difficult to achieve a tensile strength (TS) of more than 1180 MPa.

On the other hand, a tensile strength (TS) of 1180 MPa or more, or 1320 MPa or more in the future is required for a steel sheet used as a material for automobile parts such as a door impact beam and a bumper reinforcement member which are formed by performing press forming and which are particularly required to have sufficient strength to inhibit deformation at the time of an automobile collision. In addition, a tensile strength (TS) of 980 MPa or more, or 1180

MPa or more in the future is required for kinds of members, which are structural parts having relatively complex shapes, and structural members such as a center pillar inner member.

In view of the situation described above, an object of the present disclosure is to provide a high-strength steel sheet having a tensile strength (TS) of 1320 MPa or more and excellent workability and a method for manufacturing the high-strength steel sheet.

Solution to Problem

In order to solve the problems described above, investigations were diligently conducted regarding the chemical composition and microstructure of a steel sheet. As a result, it was found that it is possible to obtain a high-strength steel sheet which is excellent in terms of workability, in particular, highly excellent in terms of the strength-ductility balance and the strength-stretch flange formability balance and which has a tensile strength of 1320 MPa or more by increasing the strength of a steel sheet through the utilization of martensite and a lower bainite microstructure and by stabilizing tempering of martensite, lower bainite transformation, and retained austenite after having increased the C content in a steel sheet to 0.20% or more and having allowed some of the austenite to transform into martensite as a result of performing rapid cooling on a steel sheet annealed in a temperature range in which a single austenite phase is formed.

Exemplary embodiments of the present disclosure are as follows.

[1] A high-strength steel sheet having a chemical composition containing, by mass %, C: 0.20% or more and 0.40% or less, Si: 0.5% or more and 2.5% or less, Mn: more than 2.4% and 5.0% or less, P: 0.1% or less, S: 0.01% or less, Al: 0.01% or more and 0.5% or less, N: 0.010% or less, and the balance being Fe and inevitable impurities, a steel sheet microstructure including, in terms of area fraction with respect to the whole steel sheet microstructure, lower bainite in an amount of 40% or more and less than 85%, martensite including tempered martensite in an amount of 5% or more and less than 40%, retained austenite in an amount of 10% or more and 30% or less, and polygonal ferrite in an amount of 10% or less (including 0%), a tensile strength of 1320 MPa or more, (tensile strength×total elongation) of 18000 MPa·% or more, and (tensile strength×hole expansion ratio) of 40000 MPa·% or more.

[2] The high-strength steel sheet according to item [1], in which an average crystal grain diameter of the retained austenite in the steel sheet microstructure is 2.0 μm or less.

[3] The high-strength steel sheet according to item [1] or [2], in which an average C content in the retained austenite in the steel sheet microstructure is 0.60 mass % or more.

[4] The high-strength steel sheet according to any one of items [1] to [3], in which the chemical composition further contains, by mass %, one, two, or all selected from V: 1.0% or less, Mo: 0.5% or less, and Cu: 2.0% or less.

[5] The high-strength steel sheet according to any one of items [1] to [4]; in which the chemical composition further contains, by mass %, one or both selected from Ti: 0.1% or less and Nb: 0.1% or less.

[6] The high-strength steel sheet according to any one of items [1] to [5], in which the chemical composition further contains, by mass %, B: 0.0050% or less.

[7] A method for manufacturing a high-strength steel sheet, the method including performing hot rolling and cold rolling on a steel slab having the chemical composition according to any one of items [1] and [4] to [6], annealing the cold-rolled steel sheet in a temperature range in which an austenite single phase is formed for a holding time of 15 seconds or more and 1000 seconds or less, cooling the annealed steel sheet at an average cooling rate of 3° C./s or more to a first temperature range of (Ms temperature −100° C.) or higher and lower than the Ms temperature, heating the cooled steel sheet to a second temperature range of 300° C. or higher, (Bs temperature—50° C.) or lower, and 400° C. or lower, and holding the heated steel sheet in the second temperature range for 15 seconds or more and 1000 seconds or less.

[8] The method for manufacturing a high-strength steel sheet according to item [7], in which the hot rolling includes rough rolling in which a rolling reduction of a first pass of the rough rolling is 10% or more and 15% or less and finish rolling in which a rolling reduction of a first pass of the finish rolling is 10% or more and 15% or less.

Here, in the present disclosure, the term "high-strength steel sheet" denotes a steel sheet having a tensile strength (TS) of 1320 MPa or more, and the meaning of the term includes a cold rolled steel sheet and a cold-rolled steel sheet which has been subjected to a surface treatment such as a coating treatment and a coating-alloying treatment. In addition, in the present disclosure, the term "excellent in terms of workability" denotes a case where the product of tensile strength (TS) and total elongation (T.EL), that is, (TS×T.EL), is 18000 MPa·% or more and the product of tensile strength (TS) and hole expansion ratio (λ), that is, (TS×λ), is 40000 MPa·% or more, or more in detail, a case where the expressions λ≥32% and T.EL≥16% are satisfied for a tensile strength (TS) of 1320 MPa or more and less than 1470 MPa, or the expressions λ≥25% and T.EL≥15% are satisfied for a tensile strength (TS) of 1470 MPa or more.

Advantageous Effects

According to the present disclosure, it is possible to obtain a high-strength steel sheet excellent in terms of workability. Since the high-strength steel sheet according to the present disclosure has a TS of 1320 MPa or more, excellent ductility represented by (TS×T.EL) of 18000 MPa·% or more, and excellent stretch flange formability represented by (TS×λ) of 40000 MPa·% or more, the high-strength steel sheet can preferably be used for, for example, the structural members of an automobile, which has a marked effect on the industry.

BRIEF DESCRIPTION OF DRAWINGS

[FIG. 1] FIG. 1(A) is a partial enlarged schematic diagram illustrating upper bainite, and FIG. 1(B) is a partial enlarged schematic diagram illustrating lower bainite.

DESCRIPTION OF EMBODIMENTS

Hereafter, the exemplary embodiments of the present disclosure will be described in detail.

First, the reasons of limitations on the chemical composition of the high-strength steel sheet according to the present disclosure will be described. Hereinafter, "%" used when describing a chemical composition denotes "mass %", unless otherwise noted.

C: 0.20% or more and 0.40% or less

C is a chemical element which is indispensable for increasing strength of a steel sheet and for stably forming a desired amount of retained austenite and which is required for forming a desired amount of martensite and for retaining austenite at room temperature. In the case where the C content is less than 0.20%, it is difficult to achieve the desired strength and workability of a steel sheet. Therefore, the C content is set to be 0.20% or more, preferably 0.25% or more, or more preferably 0.30% or more. On the other hand, in the case where the C content is more than 0.40%, since there is a significant increase in the hardness of a weld zone and a welded heat affected zone when a steel sheet is processed into a member, there is a deterioration in weldability. Therefore, the C content is set to be 0.40% or less, or preferably 0.36% or less.

Si: 0.5% or more and 2.5% or less

Si is a chemical element which is effective for contributing to an increase in the strength of steel through solid solution hardening and for inhibiting the formation of carbides. Accordingly, the Si content is set to be 0.5% or more. However, in the case where the Si content is more than 2.5%, there may be a decrease in surface quality and phosphatability due to the generation of, for example, red scale. Therefore, the Si content is set to be 2.5% or less. Thus, the Si content is set to be 0.5% or more and 2.5% or less.

Mn: more than 2.4% and 5.0% or less

Since Mn is effective for increasing the strength of steel and for stabilizing austenite, Mn is a chemical element which is important for the present disclosure. In the case where the Mn content is 2.4% or less, since the amount of ferrite formed may be more than 10% even if a cooling rate after annealing is 3° C./s or more, it is difficult to achieve a strength of 1320 MPa or more. Therefore, the Mn content is set to be more than 2.4%, or preferably 3.0% or more. However, in the case where the Mn content is more than 5.0%, for example, there is a deterioration in casting performance, and bainite transformation is inhibited. Therefore, it is necessary that the Mn content be 5.0% or less. Thus, the Mn content is set to be 5.0% or less, or preferably 4.5% or less.

P: 0.1% or less

P is a chemical element which is effective for increasing the strength of steel. However, in the case where the P content is more than 0.1%, there is a deterioration in impact resistance due to brittle caused by grain-boundary segregation. In addition, in the case where a galvannealing treatment is performed on a steel sheet, there is a significant decrease in alloying rate. Therefore, the P content is set to be 0.1% or less, or preferably 0.05% or less. Here, although it is preferable that the P content be decreased, there is a significant increase in cost when an attempt is made to control the P content to be less than 0.005%. Therefore, it is preferable that the lower limit of the P content be 0.005%.

S: 0.01% or less

Since S causes a deterioration in impact resistance and cracking along the metal flow of a weld zone as a result of forming inclusions such as MnS, it is preferable that the S content be as low as possible. Therefore, the S content is set to be 0.01% or less, preferably 0.005% or less, or more preferably 0.001% or less. Here, since there is a significant increase in manufacturing costs when an attempt is made to control the S content to be less than 0.0005%, it is preferable that the lower limit of the S content be 0.0005% from the viewpoint of manufacturing costs.

Al: 0.01% or more and 0.5% or less

Al is an effective chemical element which is added as a deoxidizing agent in a steel-making process. It is necessary that the Al content be 0.01% or more in order to realize such an effect. On the other hand, in the case where the Al content is more than 0.5%, there is an increased risk of slab cracking when continuous casting is performed. Therefore, the Al content is set to be 0.01% or more and 0.5% or less.

N: 0.010% or less

Since N is a chemical element which most deteriorates the aging resistance of steel, it is preferable that the N content be as low as possible. In the case where the N content is more than 0.010%, there is a marked deterioration in aging resistance. Therefore, the N content is set to be 0.010% or less. Here, since there is a significant increase in manufacturing costs when an attempt is made to control the N content to be less than 0.001%, it is preferable that the lower limit of the N content be 0.001% from the viewpoint of manufacturing costs.

The remainder is iron (Fe) and inevitable impurities.

Although it is possible for the steel sheet according to the present disclosure to achieve the intended properties with the indispensable constituent chemical elements described above, the chemical elements described below may be added as needed in addition to the indispensable constituent chemical elements described above.

One, two, or all selected from V: 1.0% or less, Mo: 0.5% or less, and Cu: 2.0% or less In the case where the V content is more than 1.0%, the Mo content is more than 0.5%, or the Cu content is more than 2.0%, since there is an excessive increase in the amount of hard martensite formed, it is not possible to achieve the desired workability. Therefore, in the case where V, Mo, and Cu are added, one, two, or all of V: 1.0% or less, Mo: 0.5% or less, and Cu: 2.0% or less should be added. Here, V, Mo, and Cu are chemical elements which have a function of inhibiting the formation of pearlite when cooling is performed from an annealing temperature. In order to realize such an effect, it is preferable that one, two, or all of V: 0.005% or more, Mo: 0.005% or more, and Cu: 0.05% or more be added.

One or both selected from Ti: 0.1% or less and Nb: 0.1% or less

In the case where the Ti content or the Nb content is more than 0.1%, there is a decrease in workability and shape fixability. Therefore, in the case where Ti and Nb are added, the content of each of Ti and Nb is set to be 0.1% or less. Here, Ti and Nb are effective for the precipitation strengthening of steel, and it is preferable that one or both of Ti and Nb be added in an amount of 0.01% or more each in order to realize such an effect.

B: 0.0050% or less

In the case where the B content is more than 0.0050%, there is a decrease in workability. Therefore, in the case where B is added, the B content is set to be 0.0050% or less. Here, B is a chemical element which is effective for inhibiting the formation and growth of polygonal ferrite from austenite grain boundaries. In order to realize such an effect, it is preferable that the B content be 0.0003% or more.

Hereafter, a microstructure and so forth, which are important factors of the high-strength steel sheet according to the present disclosure, will be described. Hereinafter, an area fraction refers to an area fraction with respect to the whole steel sheet microstructure.

Area fraction of lower bainite: 40% or more and less than 85%

The formation of bainitic ferrite through bainite transformation is necessary in order to form retained austenite, which increases strain-decomposition capability by realizing the TRIP effect in a high-strain range when processing is performed, by increasing the C concentration in untransformed austenite. Transformation from austenite to bainite occurs in a wide temperature range of about 150° C. to 550°

C., and various kinds of bainite are formed in this temperature range. Although such various kinds of bainite are conventionally defined as bainite in a simple manner in many cases, it is necessary to clearly define a bainite structure in order to achieve the intended tensile strength and workability in the present disclosure. Therefore, in the present disclosure, upper bainite and lower bainite are defined as follows. Hereafter, description will be made with reference to FIG. 1.

With reference to FIG. 1(A), the term "upper bainite" denotes lath-structured bainitic ferrite which is formed so that carbides growing in the same direction do not exist within the grains of the lath-structured bainitic ferrite and carbides exist at grain boundaries of the lath-structured bainitic ferrite. In addition, with reference to FIG. 1(B), the term "lower bainite" denotes lath-structured bainitic ferrite which is formed so that carbides growing in the same direction exist within the grains of the lath-structured bainitic ferrite. That is, it is possible to distinguish between upper bainite and lower bainite by the presence or absence of carbides growing in the same direction within the grains of bainitic ferrite. Such a difference in the state of carbides being formed in grains of bainitic ferrite has a large effect on the strength of a steel sheet. Upper bainite, which has no carbide within the grains of bainitic ferrite, is softer than lower bainite. Therefore, it is necessary that the area fraction of lower bainite be 40% or more in order to achieve the intended tensile strength in the present disclosure. On the other hand, in the case where the area fraction of lower bainite is 85% or more, it is not possible to form sufficient amount of retained austenite to achieve the intended workability in the present disclosure. Therefore, the area fraction of lower bainite is set to be less than 85%. Thus, the area fraction of lower bainite is set to be 40% or more and less than 85%. It is preferable that the area fraction be 50% or more. It is preferable that the area fraction be less than 80%.

Area fraction of martensite including tempered martensite: 5% or more and less than 40%

Martensite is a hard phase and increases the strength of a steel sheet. In addition, by forming martensite before bainite transformation occurs, bainite transformation is promoted. Therefore, in the case where the area fraction of martensite including tempered martensite is less than 5%, since it is not possible to sufficiently promote bainite transformation, it is not possible to achieve the above-described area fraction of lower bainite. On the other hand, in the case where the area fraction of martensite including tempered martensite is 40% or more, since it is not possible to stably form a sufficient amount of retained austenite due to a decrease in the amount of bainite structure, there is a problem of a decrease in workability such as ductility. Therefore, the area fraction of martensite including tempered martensite is set to be 5% or more and less than 40%. It is preferable that the area fraction be 10% or more. It is preferable that the area fraction be 30% or less.

Here, it is necessary to clearly distinguish martensite from lower bainite described above, and it is possible to identify martensite by performing microstructure observation. Specifically, while a carbide does not exist within a phase in the case of martensite in the quenched state which has not been tempered, carbides growing in random directions exist within a phase in the case of tempered martensite. In the case of lower bainite, carbides growing in the same direction exist within grains of lath-structured bainitic ferrite as described above. Here, it is possible to determine the area fractions of the phases by using the method described in EXAMPLES below.

Proportion of tempered martensite to all martensite: 80% or more (preferable condition)

In the case where the proportion of tempered martensite with respect to the area of all the martensite is less than 80%, although it is possible to achieve a tensile strength of 1320 MPa or more, there may be a case where it is not possible to achieve sufficient ductility. This is because, in the case where there is an increase in the amount of martensite in the quenched state, which contains a large amount of C and thus is poor in terms of deformability and toughness due to very high hardness, brittle fracturing occurs when strain is applied, which hinders excellent ductility or stretch flange formability from being achieved. In the case where such martensite in the quenched state is tempered, since there is a significant improvement in the deformability of martensite although there is a slight decrease in strength, brittle fracturing does not occur when strain is applied. Therefore, according to the microstructure configuration of the present disclosure, it is possible to achieve (TS×T.EL) of 18000 MPa·% or more and (TS×λ) of 40000 MPa·% or more. In addition, in the case where the proportion of tempered martensite with respect to the area of all the martensite is 80% or more, it is easy to achieve a tensile strength of 1000 MPa or more. Therefore, it is preferable that the proportion of tempered martensite with respect to the area of all the martensite in a steel sheet be 80% or more, or more preferably 90% or more. Here, since tempered martensite is identified as martensite within which fine carbides are precipitated by performing, for example, observation through the use of a scanning electron microscope (SEM), it is possible to clearly distinguish such a phase from martensite in the quenched state within which such carbides are not precipitated. It is possible to determine the area fractions of the phases by using the method described in EXAMPLES below.

Area fraction of retained austenite: 10% or more and 30% or less

Retained austenite transforms into martensite through the TRIP effect when processing is performed, and thus an increase in strength is promoted through the use of hard martensite containing a large amount of C and there is an improvement in ductility due to an increase in strain dispersibility.

In the case of the steel sheet according to the present disclosure, after partial martensite transformation is allowed to occur, retained austenite which particularly has a high carbon concentration is formed through the utilization of, for example, lower bainite transformation in which the formation of carbides is inhibited. As a result, it is possible to form retained austenite with which it is possible to realize the TRIP effect even in a high-strain range when processing is performed.

In the case where the area fraction of retained austenite is less than 10%, it is not possible to realize sufficient TRIP effect. On the other hand, in the case where the area fraction is more than 30%, since there is an excessive increase in the amount of hard martensite, which is formed after the TRIP effect realized, there is a problem of, for example, a deterioration in toughness and stretch flange formability. Therefore, the area fraction of retained austenite is set to be 10% or more and 30% or less. It is preferable that the area fraction be 14% or more, or more preferably 18% or more. It is preferable that the area fraction be 25% or less, or more preferably 22% or less.

By utilizing retained austenite, lower bainite, and martensite described above in combination, it is possible to achieve good workability even in a high-strength range represented by a tensile strength (TS) of 1320 MPa or more. The term "good workability" specifically denotes a case where (TS×T.EL) is 18000 MPa·% or more and (TS×λ) is 40000 MPa·% or more, that is, a case where it is possible to obtain a steel sheet highly excellent in terms of the strength-workability balance.

Here, since retained austenite is distributed in the state of being surrounded by martensite and lower bainite, it is difficult to accurately determine the amount (area fraction) of retained austenite by performing microstructure observation. However, it is possible to determine the area fraction by using a method for determining the amount of retained austenite which has been conventionally used, that is, a method for determining intensity through the use of X-ray diffractometry (XRD), or specifically, a method for determining the ratio of the X-ray diffraction intensity of austenite to that of ferrite. Here, it is possible to determine the area fraction of retained austenite by using the method described in EXAMPLES below. In the present disclosure, it is clarified that, in the case where the area fraction of retained austenite is 10% or more, it is possible to realize sufficient TRIP effect and therefore a TS of 1320 MPa or more, (TS×T.EL) of 18000 MPa·% or more, and (TS×λ) of 40000 MPa·% or more are achieved.

Area fraction of polygonal ferrite: 10% or less (including 0%)

In the case where the area fraction of polygonal ferrite is more than 10%, it is difficult to achieve a tensile strength of 1320 MPa or more. At the same time, since strain is concentrated in soft polygonal ferrite, which is mixed in hard phases when processing is performed, cracking tends to occur when processing is performed, which hinders the desired workability from being achieved. Here, in the case where the area fraction of polygonal ferrite is 10% or less, since a small amount of polygonal ferrite is dispersed in hard phases in the state of being isolated even if polygonal ferrite exists, it is possible to inhibit the concentration of strain, which makes it possible to avoid a deterioration in workability. In addition, in the case where the area fraction of polygonal ferrite is more than 10%, since there is a decrease in yield strength to 1000 MPa or less, there is insufficient strength when a steel sheet is used for automobile parts. Therefore, the area fraction of polygonal ferrite is set to be 10% or less, preferably 5% or less, or more preferably 3% or less. The area ratio may be 0%. Here, it is possible to determine the area fraction of polygonal ferrite by using the method described in EXAMPLES below.

Average C content in retained austenite: 0.60 mass % or more (preferable condition)

In order to achieve excellent workability by utilizing the TRIP effect, the carbon content in retained austenite is important in the case of a high-strength steel sheet having a tensile strength of 1320 MPa or more. In the case of the steel sheet according to the present disclosure, when the average C content in retained austenite determined from the amount of the diffraction peak shift in X-ray diffractometry (XRD), which is a conventional method for determining the average C content in retained austenite (the average of the C content in retained austenite), is 0.60 mass % or more, it is possible to achieve highly excellent workability. When the average C content in retained austenite is less than 0.60 mass %, since martensite transformation occurs in a low-strain range when processing is performed, there may be a case where it is not possible to sufficiently realize the TRIP effect in a high-strain range, which improves workability. Therefore, it is preferable that the average C content in retained austenite be 0.60 mass % or more, or more preferably 0.70 mass % or more. On the other hand, when the average C content in retained austenite is more than 2.00 mass %, since retained austenite becomes excessively stable, martensite transformation does not occur when processing is performed, which results in a risk of a decrease in ductility due to the TRIP effect not being realized. Therefore, it is preferable that the average C content in retained austenite be 2.00 mass % or less.

Average crystal grain diameter of retained austenite: 2.0 μm or less (preferable condition)

In the case where the average crystal grain diameter of retained austenite is large, since a portion of such retained austenite having a large crystal grain diameter in which transformation occurs becomes a starting point at which cracking occurs when processing is performed, there may be a case of a deterioration in stretch flange formability. Therefore, it is preferable that the average crystal grain diameter of retained austenite be 2.0 μm or less, or more preferably 1.8 μm or less. Here, it is possible to determine the average crystal grain diameter of retained austenite by using the method described in EXAMPLES below.

Hereafter, the method for manufacturing the high-strength steel sheet according to the present disclosure will be described.

It is possible to manufacture the high-strength steel sheet according to the present disclosure by performing hot rolling and cold rolling on a steel slab having the chemical composition described above, annealing the cold-rolled steel sheet in a temperature range in which an austenite single phase is formed for a holding time of 15 seconds or more and 1000 seconds or less, cooling the annealed steel sheet at an average cooling rate of 3° C./s or more to a first temperature range of (Ms temperature—100° C.) or higher and lower than the Ms temperature, heating the cooled steel sheet to a second temperature range of 300° C. or higher, (Bs temperature—50° C.) or lower, and 400° C. or lower, and holding the heated steel sheet in the second temperature range for 15 seconds or more and 1000 seconds or less.

Hereafter, description will be made in detail.

In the present disclosure, after a steel slab prepared to have a preferable chemical composition is manufactured, hot rolling and subsequent cold rolling are performed on the steel slab to obtain a cold-rolled steel sheet.

In the present disclosure, although there is no particular limitation on such treatments and commonly used methods may be used, preferable manufacturing conditions are as follows. After a steel slab is heated to a temperature range of 1000° C. or higher and 1300° C. or lower, rough rolling in which the rolling reduction of the first pass of the rough rolling is 10% or more and 15% or less is performed, finish rolling in which the rolling reduction of the first pass of the finish rolling is 10% or more and 15% or less and in which the finishing delivery temperature is 870° C. or higher and 950° C. or lower is performed, and the obtained hot-rolled steel sheet is coiled at a temperature of 350° C. or higher and 720° C. or lower after the hot rolling has been performed. Subsequently, after the hot-rolled steel sheet is pickled, cold rolling is performed with rolling reduction of 40% or more and 90% or less, a cold-rolled steel sheet having a thickness of 0.5 mm or more and 5.0 mm or less is obtained.

In the hot rolling, by controlling the rolling reduction of the first pass of the rough rolling to be 10% or more and 15% or less, and by controlling the rolling reduction of the first pass of the finish rolling to be 10% or more and 15% or less, it is possible to decrease the degree of the surface segregation of Mn. Here, in the case where the rolling reduction of the first pass of the rough rolling is less than 10%, since there is no decrease in the degree of Mn segregation, there is a deterioration in the formability of a steel sheet. Although it is possible to realize a certain level of effect of decreasing the degree of Mn segregation in the case where the rolling reduction is 10% or more, there is an increase in rolling load in the case where the rolling reduction is more than 15%. Therefore, the upper limit of the rolling reduction is set to be 15% or less. It is preferable that the rolling reduction of the first pass of the rough rolling be 12% or more and 15% or less. In addition, in the case where the rolling reduction of the first pass of the finish rolling is less than 10%, since there is no decrease in the degree of Mn segregation, there is a deterioration in the formability of a steel sheet. Although it is possible to realize a certain level of effect of decreasing the degree of Mn segregation in the case where the rolling reduction is 10% or more, there is an increase in rolling load in the case where the rolling reduction is more than 15%. Therefore, the upper limit of the rolling reduction is set to be 15% or less. It is preferable that the rolling reduction of the first pass of the finish rolling be 12% or more and 15% or less.

Here, although the present disclosure is based on the assumption that a steel sheet is manufactured through ordinary process including steel-making, casting, hot rolling, pickling, and cold rolling, all or part of a hot rolling process may be omitted by using, for example, a thin-slab casting method or a strip casting method.

The obtained cold-rolled steel sheet is subjected to the following heat treatment (annealing).

Annealing is performed in which the cold-rolled steel sheet is held in a temperature range in which an austenite single phase is formed for 15 seconds or more and 1000 seconds or less.

The steel sheet according to the present disclosure has a microstructure including mainly low-temperature-transformation phases such as martensite and lower bainite, which are formed as a result of the transformation of untransformed austenite, and it is preferable that the amount of polygonal ferrite included be as small as possible. Therefore, it is necessary to perform annealing in a temperature range in which an austenite single phase is formed. There is no particular limitation on the annealing temperature as long as the temperature is within a range in which an austenite single phase is formed. However, in the case where the annealing temperature is higher than 1000° C., since there is a significant growth of austenite grains, there is an increase in the grain diameter of phases formed when subsequent cooling is performed, which results in a deterioration in, for example, toughness. Therefore, it is necessary that the annealing temperature be equal to or higher than the Ac3 temperature (° C.), that is, austenite transformation completion temperature, and it is preferable that the annealing temperature be 1000° C. or lower.

Here, it is possible to calculate the Ac3 temperature by using the equation below. Here, under the assumption that symbol X is used instead of the atomic symbol of some constituent chemical element of a steel sheet, symbol [X %] denotes the content (mass %) of the chemical element represented by symbol X, and symbol [X %] is assigned a value of 0 in the case of a chemical element which is not contained.

$$\text{Ac3 temperature (° C.)}=910-203\times[\text{C }\%]^{1/2}+44.7\times[\text{Si }\%]-30\times[\text{Mn }\%]+700\times[\text{P }\%]+400\times[\text{Al }\%]-20\times[\text{Cu }\%]+31.5\times[\text{Mo }\%]+104\times[\text{V }\%]+400\times[\text{Ti}\%]$$

In addition, in the case where the annealing time is less than 15 seconds, there may be a case where reverse transformation into austenite does not sufficiently progress or a case where carbides in a steel sheet are not sufficiently dissolved. On the other hand, in the case where the annealing time is more than 1000 seconds, there is an increase in cost due to a large energy consumption. Therefore, the annealing time is set to be 15 seconds or more and 1000 seconds or less. It is preferable that the annealing time be 60 seconds or more. It is preferable that the annealing time be 500 seconds or less.

The annealed cold-rolled steel sheet is cooled at an average cooling rate of 3° C./s or more to a first temperature range of (Ms temperature—100° C.) or higher and lower than the Ms temperature.

This cooling is intended to allow part of austenite to transform into martensite by cooling the steel sheet to a temperature lower than the Ms temperature, that is, martensite transformation start temperature. In the case where the lower limit of the first temperature range is lower than (Ms temperature—100° C.), since there is an excessive amount of untransformed austenite transforming into martensite, it is not possible to simultaneously achieve excellent strength and workability. On the other hand, in the case where the upper limit of the first temperature range is equal to or higher than the Ms temperature, it is not possible to form an appropriate amount of martensite. Therefore, the first temperature range is set to be (Ms temperature—100° C.) or higher and lower than the Ms temperature. It is preferable that the temperature range be (Ms temperature—80° C.) or higher, or more preferably (Ms temperature—50° C.) or higher.

In addition, in the case where the average cooling rate is less than 3° C./s, since excessive formation and growth of polygonal ferrite and the precipitation of pearlite, upper bainite, and so forth occur, it is not possible to form the desired steel sheet microstructure. Therefore, the average cooling rate from the annealing temperature to the first temperature range is set to be 3° C./s or more, preferably 5° C./s or more, or more preferably 8° C./s or more. Here, although there is no particular limitation on the upper limit of the average cooling rate as long as there is no variation in the cooling stop temperature, it is preferable that the upper limit be 100° C./s or less.

Here, it is preferable that the Ms temperature described above be determined by performing actual measurement such as measurement in which thermal expansion coefficient or electric resistance is determined through the use of, for example, a formaster test when cooling is performed. However, the Ms temperature may be derived by using, for example, the approximate equation below. Ms temperature is an approximate value which is derived on an empirical basis. Here, among the values of the Ms temperature which are derived by performing actual measurements through the use of, for example, a formaster test or by using the approximate equation, the lowest one is used.

$$\text{Ms temperature (° C.)}=565-31\times[\text{Mn }\%]-13\times[\text{Si }\%]-12\times[\text{Mo }\%]-600\times(1-\exp(-0.96\times[\text{C }\%]))$$

Here, under the assumption that symbol X is used instead of the atomic symbol of some constituent chemical element of a steel sheet, symbol [X %] denotes the content (mass %) of the chemical element represented by symbol X, and symbol [X %] is assigned a value of 0 in the case of a chemical element which is not contained.

The steel sheet which has been cooled to the first temperature range is heated to a second temperature range of 300° C. or higher, (Bs temperature—50° C.) or lower, and 400° C. or lower and held in the second temperature range for 15 seconds or more and 1000 seconds or less.

In the second temperature range, the stabilization of austenite is promoted, for example, by tempering martensite, which has been formed by performing cooling from the annealing temperature to the first temperature range, and by allowing untransformed austenite to transform into lower bainite so that solid solution C is concentrated in austenite. Since the steel according to the present disclosure contains Mn in a large amount of more than 2.4% and 5.0% or less, there is a decrease in the appropriate temperature range for lower bainite transformation. Therefore, it is necessary that the second temperature range be 300° C. or higher, (Bs temperature—50° C.) or lower, and 400° C. or lower. In the case where the upper limit of the second temperature range is higher than the lower of (Bs temperature—50° C.) or lower and 400° C. or lower, upper bainite is formed instead of lower bainite, or bainite transformation is inhibited. On the other hand, in the case where the lower limit of the second temperature range is lower than 300° C., since there is a significant decrease in the diffusion rate of solid solution C, there is a decrease in the amount of solid solution C concentrated in austenite due to lower bainite not being formed, which hinders the desired C concentration from being achieved in retained austenite. Therefore, the second temperature range is set to be 300° C. or higher, (Bs temperature—50° C.) or lower, and 400° C. or lower. It is preferable the second temperature range be 320° C. or higher. It is preferable that the second temperature range be (Bs temperature—50° C.) or lower, and 380° C. or lower. Here, the first temperature range is lower than the second temperature range.

In addition, in the case where the holding time in the second temperature range is less than 15 seconds, since martensite is not sufficiently tempered and lower bainite transformation does not sufficiently occur, it is not possible to form the desired steel sheet microstructure. As a result, there may be a case where it is not possible to achieve sufficient workability of a steel sheet obtained. Therefore, it is necessary that the lower limit of the holding time in the second temperature range be 15 seconds. On the other hand, it is sufficient that the upper limit of the holding time in the second temperature range be 1000 seconds because of the effect of promoting bainite transformation through the use of martensite which is formed in the first temperature range. Usually, in the case where the amount of alloy chemical elements such as C and Mn is large, bainite transformation is delayed. However, since martensite and untransformed austenite coexist in the present disclosure, there is a significant increase in bainite transformation rate. In the present disclosure, such a function is utilized to realize the effect of promoting bainite transformation. Here, in the case where the holding time in the second temperature range is more than 1000 seconds, since carbides are precipitated from untransformed austenite in the final microstructure of a steel sheet, it is not possible to form stable retained austenite in which C is concentrated. As a result, there may be a case where it is not possible to achieve the desired strength and/or ductility. Therefore, the holding time in the second temperature range is set to be 15 seconds or more and 1000 seconds or less. It is preferable that the holding time be 100 seconds or more. It is preferable that the holding time be 700 seconds or less.

Here, the term "the Bs temperature" described above denotes a bainite transformation start temperature. Although it is preferable that the Bs temperature be determined by performing actual measurement such as measurement in which thermal expansion coefficient or electric resistance is determined through the use of, for example, a formaster test when cooling is performed, the Bs temperature may be derived by using, for example, the approximate equation below. Bs temperature is an approximate value which is derived on an empirical basis.

$$\text{Bs temperature (° C.)} = 830 - 270 \times [\text{C \%}] - 90 \times [\text{Mn \%}] - 83 \times [\text{Mo \%}]$$

Here, under the assumption that symbol X is used instead of the atomic symbol of some constituent chemical element of a steel sheet, symbol [X %] denotes the content (mass %) of the chemical element represented by symbol X, and symbol [X %] is assigned a value of 0 in the case of a chemical element which is not contained.

Here, in the series of heat treatments in the present disclosure, it is not necessary that the holding temperatures be constant as long as the temperatures are within the specified ranges described above, and there is no decrease in the effects of the present disclosure even in the case where the temperatures vary within the specified ranges. The same goes for the cooling rates. In addition, a steel sheet may be subjected to the heat treatments by using any equipment as long as the thermal history conditions are satisfied. Moreover, performing skin pass rolling on the surface of a steel sheet for correcting its shape after the heat treatments is within the scope of the present disclosure. Furthermore, performing surface treatment such as a coating treatment and a coating-alloying treatment on a cold-rolled steel sheet is within the scope of the present disclosure.

EXAMPLES

By heating steel slabs which had been manufactured from molten steels having the chemical compositions given in Table 1 to a temperature of 1250° C., by performing rough rolling with the rolling ratios (rolling reductions) of the first pass of the rough rolling given in Table 2, by performing finish rolling with the rolling ratios (rolling reductions) of the first pass of the finish rolling given in Table 2 and with a finishing delivery temperature of 870° C., by coiling the hot-rolled steel sheet at a temperature of 550° C., by pickling the hot-rolled steel sheet, and by performing cold rolling with a rolling ratio (rolling reduction) of 60%, cold-rolled steel sheets having a thickness of 1.2 mm were obtained. The obtained cold-rolled steel sheets were subjected to a heat treatment under the conditions given in Table 2. Here, the term "cooling stop temperature T1" in Table 2 denotes a temperature at which the cooling of the steel sheets was stopped in the first temperature range. After the heat treatment has been performed, the obtained steel sheets were subjected to skin pass rolling with a rolling ratio (elongation ratio) of 0.3%.

The various properties of the steel sheets obtained as described above were evaluated by using the method described below.

Area Fraction of Phase

By cutting and polishing the obtained steel sheet to expose the central portion in the thickness direction in a cross section parallel to the rolling direction, by etching the exposed portion through the use of nital, by observing 10 fields of view in a plane having a normal line parallel to the width direction through the use of scanning electron microscope (SEM) at a magnification of 3000 times, the area fraction of each of various phases was determined, and the microstructure configuration of each of various crystal grains was identified. By performing image analysis in order to distinguish lower bainite, polygonal ferrite, martensite, and so forth, the area fraction of each of the phases was defined as the proportion of the area of the phase to the area of the observed field of view.

Amount of Retained Austenite

The amount of retained austenite was determined by grinding and polishing the steel sheet to a position located at ¼ of the thickness in the thickness direction and by determining the diffraction intensity in X-ray diffractometry. By using the Co-Kα ray as an incidence X-ray, the amount of retained austenite was calculated from the ratio of the diffraction intensity from the (200)-plane, (220)-plane, and (311)-plane of austenite to the diffraction intensity from the (200)-plane, (211)-plane, and (220)-plane of ferrite. Here, the amount of retained austenite obtained as described above is given in Table 3 as the area fraction of retained austenite.

Average C Content in Retained Austenite

The average C content in retained austenite was obtained by deriving the lattice constant from the intensity peaks of (200)-plane, (220)-plane, and (311)-plane of austenite in the determination of X-ray diffraction intensity and by calculating the average C content (mass %) in retained austenite through the use of the following equation.

$$a0=0.3580+0.0033\times[C\ \%]+0.00095\times[Mn\ \%]+0.0056\times[Al\ \%]+0.022\times[N\ \%]$$

Here, a0: lattice constant (nm), [X %]: content (mass %) of the chemical element represented by symbol X, and symbol [X %] is assigned a value of 0 in the case of a chemical element which is not contained, under the assumption that symbol X is used instead of the atomic symbol of some constituent chemical element of a steel sheet. Here, the contents (mass %) of chemical elements other than C were defined as those in the whole steel sheet.

Average crystal grain diameter of retained austenite The average crystal grain diameter of retained austenite was obtained by observing 10 grains of retained austenite through the use of a transmission electron microscope (TEM), by obtaining the area of each of the 10 grains from the observed microstructure image through the use of Image-Pro produced by Media Cybernetics, Inc., by calculating the circle-equivalent diameters of the 10 grains, by calculating the average circle-equivalent diameter of the 10 grains, and by defining the average value as the average crystal grain diameter of the retained austenite.

Mechanical Properties

A tensile test was performed in accordance with JIS Z 2241 on a JIS No. 5 test piece (JIS Z 2201) which was taken from the steel sheet so that the longitudinal direction thereof was the width direction of the steel sheet. By determining TS (tensile strength) and T.EL (total elongation), and by calculating the product of the tensile strength and the total elongation (TS×T.EL), the strength-workability (ductility) balance was evaluated. Here, in the present disclosure, a case where the expression TS≥1320 (MPa) was satisfied was judged as good, and a case where the expression (TS×T.EL)≥18000 (MPa·%) was satisfied was judged as good.

A test in accordance with The Japan Iron and Steel Federation Standard (JFS T 1001) was performed on a test piece of 100 mm×100 mm. By punching a hole having an initial diameter d0 of 10 mmϕ in the test piece, by expanding the hole with a conical punch having a point angle of 60° being moved upward, by stopping the punch when a crack penetrated through the thickness, by determining the punched hole diameter d after the crack had penetrated through the thickness, and by using the equation below, a hole expansion ratio was calculated. By performing the test three times for the steel sheet having the same sample number and by calculating an average hole expansion ratio (X (%)), stretch flange formability was evaluated.

$$\text{hole expansion ratio (\%)}=((d-d0)/d0)\times 100$$

By calculating the product of the tensile strength and the hole expansion ratio (TS×λ), the strength-workability (stretch flange formability) balance was evaluated. Here, in the present disclosure, a case where the expression TS×λ≥40000 (MPa·%) was satisfied was judged as good. The results obtained as described above are given in Table 3.

TABLE 1

(mass %)

| Steel Grade | C | Si | Mn | P | S | Al | N | V | Mo | Cu | Ti | Nb | B |
|---|---|---|---|---|---|---|---|---|---|---|---|---|---|
| A | 0.21 | 1.4 | 3.5 | 0.011 | 0.002 | 0.03 | 0.0024 | — | — | — | — | — | 0.0012 |
| B | 0.24 | 1.5 | 2.7 | 0.013 | 0.001 | 0.03 | 0.0023 | — | — | — | — | 0.02 | — |
| C | 0.33 | 1.5 | 3.8 | 0.014 | 0.002 | 0.04 | 0.0022 | 0.20 | — | — | — | — | — |
| D | 0.30 | 2.0 | 4.0 | 0.010 | 0.002 | 0.05 | 0.0024 | — | — | — | — | — | — |
| E | 0.15 | 1.6 | 3.4 | 0.012 | 0.002 | 0.03 | 0.0028 | — | — | — | — | — | — |
| F | 0.24 | 1.0 | 1.5 | 0.011 | 0.001 | 0.04 | 0.0032 | — | — | — | — | — | — |
| G | 0.27 | 1.2 | 4.2 | 0.017 | 0.002 | 0.05 | 0.0031 | — | — | — | — | 0.01 | — |
| H | 0.33 | 2.3 | 2.8 | 0.015 | 0.002 | 0.05 | 0.0025 | — | — | — | — | — | — |
| I | 0.35 | 1.6 | 4.0 | 0.008 | 0.002 | 0.03 | 0.0025 | — | 0.01 | — | — | — | — |
| J | 0.38 | 1.8 | 3.8 | 0.014 | 0.001 | 0.04 | 0.0031 | — | — | — | — | — | 0.0008 |
| K | 0.23 | 1.7 | 6.1 | 0.011 | 0.001 | 0.03 | 0.0030 | — | — | — | — | — | — |
| L | 0.37 | 2.2 | 2.8 | 0.015 | 0.001 | 0.04 | 0.0034 | — | — | 0.2 | — | — | — |
| M | 0.33 | 1.7 | 3.0 | 0.014 | 0.001 | 0.04 | 0.0035 | — | — | — | 0.03 | — | 0.0010 |
| N | 0.30 | 1.5 | 2.2 | 0.012 | 0.001 | 0.04 | 0.0033 | — | — | — | — | — | — |

TABLE 2

| | | Hot Rolling | | Heat Treatment | | | | | | Holding | | | |
|---|---|---|---|---|---|---|---|---|---|---|---|---|---|
| Sample No. | Steel Grade | Rolling Reduction of First Pass of Rough Rolling (%) | Rolling Reduction of First Pass of Finish Rolling (%) | Annealing Temperature (° C.) | Annealing Time (sec) | Ac3 Temperature (° C.) | Average Cooling Rate to First Temperature Range (° C./s) | Cooling Stop Temperature T1 (° C.) | Ms Temperature (° C.) | Temperature in Second Temperature Range (° C.) | Holding Time in Second Temperature Range (sec) | Bs Temperature (° C.) | Note |
| 1 | A | 12 | 12 | 880 | 200 | 794 | 8 | 200 | 329 | 380 | 400 | 458 | Example |
| 2 | A | 12 | 12 | 880 | 300 | 794 | 11 | 310 | 329 | 380 | 600 | 458 | Example |
| 3 | A | 12 | 12 | 870 | 300 | 794 | 10 | 120 | 329 | 370 | 600 | 458 | Comparative Example |
| 4 | B | 12 | 12 | 870 | 250 | 818 | 6 | 290 | 338 | 390 | 500 | 522 | Example |
| 5 | B | 12 | 12 | 780 | 400 | 818 | 8 | 240 | 338 | 400 | 500 | 522 | Comparative Example |
| 6 | C | 12 | 12 | 880 | 150 | 793 | 7 | 230 | 265 | 330 | 600 | 399 | Example |
| 7 | C | 12 | 5 | 820 | 300 | 793 | 13 | 220 | 265 | 340 | 300 | 399 | Example |
| 8 | D | 12 | 12 | 850 | 250 | 795 | 5 | 220 | 265 | 330 | 800 | 389 | Example |
| 9 | D | 12 | 12 | 870 | 350 | 795 | 7 | 300 | 265 | 320 | 500 | 389 | Comparative Example |
| 10 | D | 5 | 12 | 870 | 300 | 795 | 6 | 230 | 265 | 280 | 600 | 389 | Comparative Example |
| 11 | E | 12 | 12 | 860 | 200 | 821 | 10 | 320 | 358 | 380 | 600 | 484 | Comparative Example |
| 12 | F | 12 | 12 | 850 | 300 | 834 | 15 | 350 | 382 | 400 | 500 | 630 | Comparative Example |
| 13 | G | 12 | 12 | 860 | 400 | 764 | 13 | 200 | 282 | 320 | 500 | 379 | Example |
| 14 | H | 12 | 12 | 880 | 350 | 843 | 5 | 240 | 285 | 370 | 300 | 489 | Example |
| 15 | H | 12 | 12 | 870 | 300 | 843 | 1 | 250 | 285 | 390 | 400 | 489 | Comparative Example |
| 16 | H | 12 | 12 | 880 | 400 | 843 | 6 | 250 | 285 | 460 | 500 | 489 | Comparative Example |
| 17 | I | 12 | 12 | 870 | 250 | 759 | 8 | 210 | 249 | 310 | 600 | 375 | Example |
| 18 | J | 12 | 12 | 860 | 400 | 777 | 11 | 210 | 240 | 320 | 700 | 385 | Example |
| 19 | K | 12 | 12 | 840 | 350 | 725 | 10 | 200 | 235 | 350 | 600 | 219 | Comparative Example |
| 20 | L | 12 | 12 | 870 | 250 | 823 | 5 | 200 | 270 | 380 | 600 | 478 | Example |
| 21 | M | 12 | 12 | 860 | 300 | 817 | 7 | 250 | 287 | 370 | 500 | 471 | Example |
| 22 | N | 12 | 12 | 850 | 300 | 824 | 3 | 250 | 327 | 400 | 500 | 551 | Comparative Example |

Note 1:

Ac3 temperature (° C.) = 910 − 203 × [C %]$^{1/2}$ + 44.7 × [Si %] − 30 × [Mn %] + 700 × [P %] + 400 × [Al %] − 20 × [Cu %] + 31.5 × [Mo %] + 104 × [V %] + 400 × [Ti %], where, under the assumption that symbol X is used instead of the atomic symbol of some constituent chemical element of a steel sheet, symbol [X %] denotes the content (mass %) of the chemical element represented by symbol X, and symbol [X %] is assigned a value of 0 in the case of a chemical element which is not contained.

Note 2:

Ms temperature (° C.) = 565 − 31 × [Mn %] − 13 × [Si%] − 12 × [Mo %] − 600 × (1 − exp(−0.96 × [C %])), where, under the assumption that symbol X is used instead of the atomic symbol of some constituent chemical element of a steel sheet, symbol [X %] denotes the content (mass %) of the chemical element represented by symbol X, and symbol [X %] is assigned a value of 0 in the case of a chemical element which is not contained.

Note 3:

Be temperature (° C.) = 830 − 270 × [C %] − 90 × [Mn %] − 83 × [Mo %], where, under the assumption that symbol X is used instead of the atomic symbol of some constituent chemical element of a steel sheet, symbol [X %] denotes the content (mass %) of the chemical element represented by symbol X, and symbol [X %] is assigned a value of 0 in the case of a chemical element which is not contained.

TABLE 3

| Sample No. | Steel Grade | α (%) | UB (%) | LB (%) | FM (%) | TM (%) | γ (%) | (TM/FM + TM) × 100 (%) | Average Crystal Grain Diameter of Retained γ (μm) | Average C Content in Retained γ (mass %) | YS (MPa) | TS (MPa) | T.EI (%) | γ (%) | TS × T.EI (MPa · %) | TS × γ (MPa · %) | Note |
|---|---|---|---|---|---|---|---|---|---|---|---|---|---|---|---|---|---|
| 1 | A | 0 | 0 | 64 | 2 | 22 | 12 | 92 | 1.8 | 0.70 | 1125 | 1358 | 17 | 36 | 23086 | 48888 | Example |
| 2 | A | 0 | 0 | 76 | 0 | 10 | 14 | 100 | 1.7 | 0.85 | 1132 | 1397 | 17 | 44 | 23749 | 61468 | Example |
| 3 | A | 0 | 0 | 0 | 6 | 88 | 6 | 94 | 1.8 | 0.86 | 1280 | 1464 | 11 | 35 | 16104 | 51240 | Comparative Example |
| 4 | B | 0 | 0 | 55 | 2 | 27 | 16 | 93 | 1.8 | 0.94 | 1244 | 1471 | 18 | 37 | 26478 | 54427 | Example |
| 5 | B | 26 | 0 | 9 | 2 | 42 | 21 | 95 | 1.6 | 0.75 | 845 | 1187 | 22 | 16 | 26114 | 18992 | Comparative Example |

TABLE 3-continued

| Sample No. | Steel Grade | α (%) | UB (%) | LB (%) | FM (%) | TM (%) | γ (%) | (TM/FM + TM) × 100 (%) | Average Crystal Grain Diameter of Retained γ (μm) | Average C Content in Retained γ (mass %) | YS (MPa) | TS (MPa) | T.EI (%) | γ (%) | TS × T.EI (MPa · %) | TS × γ (MPa · %) | Note |
|---|---|---|---|---|---|---|---|---|---|---|---|---|---|---|---|---|---|
| 6 | C | 0 | 0 | 63 | 3 | 16 | 18 | 84 | 1.8 | 0.87 | 1262 | 1523 | 17 | 30 | 25891 | 45690 | Example |
| 7 | C | 0 | 0 | 50 | 2 | 26 | 22 | 93 | 2.5 | 1.12 | 1314 | 1568 | 20 | 33 | 31360 | 51744 | Example |
| 8 | D | 0 | 0 | 55 | 1 | 27 | 17 | 96 | 1.8 | 0.98 | 1315 | 1523 | 16 | 35 | 24368 | 53305 | Example |
| 9 | D | 0 | 0 | 37 | 55 | 0 | 8 | 0 | 1.8 | 1.23 | 1224 | 1686 | 11 | 3 | 18546 | 5058 | Comparative Example |
| 10 | D | 0 | 0 | 20 | 41 | 28 | 11 | 41 | 2.8 | 0.40 | 1245 | 1624 | 14 | 8 | 22736 | 12992 | Comparative Example |
| 11 | E | 0 | 0 | 66 | 2 | 25 | 7 | 93 | 1.8 | 0.38 | 954 | 1154 | 12 | 43 | 13848 | 49622 | Comparative Example |
| 12 | F | 12 | 0 | 62 | 1 | 19 | 6 | 95 | 1.7 | 0.86 | 926 | 1290 | 13 | 25 | 16770 | 32250 | Comparative Example |
| 13 | G | 0 | 0 | 54 | 2 | 27 | 17 | 93 | 1.8 | 0.94 | 1248 | 1426 | 17 | 32 | 24242 | 45632 | Example |
| 14 | H | 0 | 0 | 47 | 2 | 28 | 23 | 93 | 1.8 | 1.10 | 1324 | 1621 | 20 | 29 | 32420 | 47009 | Example |
| 15 | H | 0 | 35 | 21 | 2 | 16 | 26 | 89 | 1.7 | 1.03 | 998 | 1270 | 23 | 32 | 29210 | 40640 | Comparative Example |
| 16 | H | 0 | 40 | 12 | 3 | 17 | 28 | 85 | 1.8 | 0.88 | 935 | 1234 | 25 | 29 | 30850 | 35786 | Comparative Example |
| 17 | I | 0 | 0 | 55 | 2 | 21 | 22 | 91 | 1.7 | 0.78 | 1355 | 1664 | 21 | 27 | 34944 | 44928 | Example |
| 18 | J | 0 | 0 | 61 | 2 | 10 | 27 | 83 | 1.8 | 1.43 | 1449 | 1765 | 22 | 25 | 38830 | 44125 | Example |
| 19 | K | 0 | 0 | 12 | 65 | 17 | 6 | 21 | 1.7 | 0.88 | 1198 | 1644 | 10 | 5 | 16440 | 8220 | Comparative Example |
| 20 | L | 0 | 0 | 54 | 2 | 21 | 23 | 91 | 1.8 | 1.35 | 1475 | 1721 | 19 | 26 | 32699 | 44746 | Example |
| 21 | M | 0 | 0 | 58 | 1 | 18 | 23 | 95 | 1.7 | 0.75 | 1265 | 1564 | 18 | 32 | 28152 | 50048 | Example |
| 22 | N | 11 | 0 | 44 | 2 | 33 | 10 | 94 | 1.7 | 0.72 | 924 | 1276 | 16 | 31 | 20416 | 39556 | Comparative Example |

Note:
α: polygonal ferrite
UB: upper bainite
LB: lower bainite
FM: quenched martensite
TM: tempered martensite
γ: retained austenite As indicated in Table 3, in the case of the examples of the present disclosure, it is clarified that steel sheets simultaneously having high strength and excellent workability were obtained from the fact that TS was 1320 MPa or more, the value of (TS×T.EL) was 18000 MPa~% or more, and the value of (TS×X) was 40000 MPa·% or more for all the examples, the expressions λ≥32% and T.EL≥16% were satisfied for a TS of 1320 MPa or more and less than 1470 MPa, and the expressions λ≥25% and T.EL≥15% were satisfied for a TS of 1470 MPa or more.

The invention claimed is:

1. A high-strength steel sheet having a chemical composition comprising:

C: more than 0.30% and 0.40% or less, by mass %;

Si: 0.5% or more and 2.5% or less, by mass %;

Mn: 3.8% or more and 5.0% or less, by mass %;

P: 0.1% or less, by mass %;

S: 0.01% or less, by mass %;

Al: 0.01% or more and 0.5% or less, by mass %;

N: 0.010% or less, by mass %; and

Fe and inevitable impurities, wherein:

the steel sheet has a microstructure including, in terms of area fraction with respect to the whole steel sheet microstructure, lower bainite in an amount of 40% or more and less than 85%, martensite including tempered martensite in an amount of 5% or more and less than 40%, retained austenite in an amount of 10% or more and 30% or less, and having an average crystal grain diameter in a range of 1.6 μm or more an 2.0 μm or less, and polygonal ferrite in an amount of 10% or less (including 0%), the steel sheet has a tensile strength of 1320 MPa or more, (tensile strength×total elongation) of 18000 MPa·% or more, and (tensile strength×hole expansion ratio) of 40000 MPa·% or more.

2. The high-strength steel sheet according to claim 1, wherein an average C content in the retained austenite in the steel sheet microstructure is 0.60 mass % or more.

3. The high-strength steel sheet according to claim 2, wherein the chemical composition further comprises one or more groups of elements selected from the following groups A to C:

Group A:

one or more selected from:

V: 1.0% or less, by mass %,

Mo: 0.5% or less, by mass %, and

Cu: 2.0% or less, by mass %,

Group B:
one or both selected from:
Ti: 0.1% or less, by mass %, and
Nb: 0.1% or less, by mass %, and
Group C:
B: 0.0050% or less.

4. A method for manufacturing a high-strength steel sheet according to claim 3, the method comprising:
performing hot rolling and cold rolling on a steel sheet having the composition of claim 3,
annealing the cold-rolled steel sheet in a temperature range in which an austenite single phase is formed for a holding time of 15 seconds or more and 1000 seconds or less, and cooling the annealed steel sheet at an average cooling rate of 3° C/s or more to a first temperature range of (Ms temperature - 100° C.) or higher and lower than the Ms temperature, and
heating the cooled steel sheet to a second temperature range of 300° C. or higher, (Bs temperature - 50° C.) or lower, and 400° C. or lower, and holding the heated steel sheet in the second temperature range for 15 seconds or more and 1000 seconds or less.

5. The method for manufacturing a high-strength steel sheet according to claim 4, wherein the hot rolling includes:
rough rolling in which a rolling reduction of a first pass of the rough rolling is 10% or more and 15% or less and
finish rolling in which a rolling reduction of a first pass of the finish rolling is 10% or more and 15% or less.

6. A method for manufacturing a high-strength steel sheet according to claim 2, the method comprising:
performing hot rolling and cold rolling on a steel sheet having the composition of claim 2,
annealing the cold-rolled steel sheet in a temperature range in which an austenite single phase is formed for a holding time of 15 seconds or more and 1000 seconds or less, and cooling the annealed steel sheet at an average cooling rate of 3° C/s or more to a first temperature range of (Ms temperature - 100° C.) or higher and lower than the Ms temperature, and
heating the cooled steel sheet to a second temperature range of 300° C. or higher, (Bs temperature - 50° C.) or lower, and 400° C. or lower, and holding the heated steel sheet in the second temperature range for 15 seconds or more and 1000 seconds or less.

7. The method for manufacturing a high-strength steel sheet according to claim 6, wherein the hot rolling includes:
rough rolling in which a rolling reduction of a first pass of the rough rolling is 10% or more and 15% or less and
finish rolling in which a rolling reduction of a first pass of the finish rolling is 10% or more and 15% or less.

8. The high-strength steel sheet according to claim 1, wherein the chemical composition further comprises one or more groups of elements selected from the following groups A to C:
Group A:
one or more selected from:
V: 1.0% or less, by mass %,
Mo: 0.5% or less, by mass %, and
Cu: 2.0% or less, by mass %,
Group B:
one or both selected from:
Ti: 0.1% or less, by mass %, and
Nb: 0.1% or less, by mass %, and
Group C:
B: 0.0050% or less.

9. A method for manufacturing a high-strength steel sheet according to claim 8, the method comprising:
performing hot rolling and cold rolling on a steel sheet having the composition of claim 8,
annealing the cold-rolled steel sheet in a temperature range in which an austenite single phase is formed for a holding time of 15 seconds or more and 1000 seconds or less, and cooling the annealed steel sheet at an average cooling rate of 3° C/s or more to a first temperature range of (Ms temperature - 100° C.) or higher and lower than the Ms temperature, and
heating the cooled steel sheet to a second temperature range of 300° C. or higher, (Bs temperature - 50° C.) or lower, and 400° C. or lower, and holding the heated steel sheet in the second temperature range for 15 seconds or more and 1000 seconds or less.

10. The method for manufacturing a high-strength steel sheet according to claim 9, wherein the hot rolling includes:
rough rolling in which a rolling reduction of a first pass of the rough rolling is 10% or more and 15% or less and
finish rolling in which a rolling reduction of a first pass of the finish rolling is 10% or more and 15% or less.

11. A method for manufacturing a high-strength steel sheet according to claim 1, the method comprising:
performing hot rolling and cold rolling on a steel sheet having the composition of claim 1,
annealing the cold-rolled steel sheet in a temperature range in which an austenite single phase is formed for a holding time of 15 seconds or more and 1000 seconds or less, and cooling the annealed steel sheet at an average cooling rate of 3° C/s or more to a first temperature range of (Ms temperature - 100° C.) or higher and lower than the Ms temperature, and
heating the cooled steel sheet to a second temperature range of 300° C. or higher, (Bs temperature - 50° C.) or lower, and 400° C. or lower, and holding the heated steel sheet in the second temperature range for 15 seconds or more and 1000 seconds or less.

12. The method for manufacturing a high-strength steel sheet according to claim 11, wherein the hot rolling includes:
rough rolling in which a rolling reduction of a first pass of the rough rolling is 10% or more and 15% or less and
finish rolling in which a rolling reduction of a first pass of the finish rolling is 10% or more and 15% or less.

* * * * *